United States Patent [19]

Mueller et al.

[11] Patent Number: 5,027,882

[45] Date of Patent: Jul. 2, 1991

[54] DIRECT CHILL CASTING MOULD

[75] Inventors: Friedrich P. Mueller, Schifferstadt, Fed. Rep. of Germany; Guy LeBlanc, Longueuil, Canada

[73] Assignee: Alcan International Limited, Montreal, Canada

[21] Appl. No.: 446,070

[22] Filed: Dec. 5, 1989

[30] Foreign Application Priority Data

Dec. 8, 1988 [CA] Canada ..... 585387

[51] Int. Cl.[5] ..... B22D 11/124

[52] U.S. Cl. ..... 164/444; 164/487

[58] Field of Search ..... 164/443, 444, 485, 486, 164/487

[56] References Cited

U.S. PATENT DOCUMENTS

| | | | |
|---|---|---|---|
| 3,688,834 | 9/1972 | Wagstaff et al. | 164/283 |
| 4,157,728 | 6/1979 | Mitamura et al. | 164/487 |
| 4,598,763 | 7/1986 | Wagstaff et al. | 164/444 |

*Primary Examiner*—Kuang Y. Lin

*Attorney, Agent, or Firm*—Cooper & Dunham

[57] ABSTRACT

A direct chill casting device is described comprising: (a) an axially upright, open-ended direct chill casting mould plate having an inner axially extending wall or walls defining a mould cavity, an upper annular surface and a lower annular surface, the mould plate having a generally rectangular or square cross-section at points about the axis thereof with the horizontal dimensions of the cross-section being greater than the vertical height, (b) at least one coolant channel formed within the mould generally parallel to and laterally spaced from the cavity-defining walls, (c) coolant dispersal discharge passages extending downwardly and outwardly between said coolant channel and the lower surface of the mould plate adjacent the mould cavity, and (d) a coolant manifold mounted on the lower surface of the mould plate beneath the coolant channel or channels and adapted to supply coolant fluid to the coolant channel or channels.

9 Claims, 2 Drawing Sheets

DIRECT CHILL CASTING MOULD

FIELD OF THE INVENTION

This invention relates generally to the field of direct chill casting moulds having fluid cooling through an internal chamber and more particularly to such moulds providing maximum thermal stability.

BACKGROUND OF THE INVENTION

Direct chill casting is a technique in which aluminum or other molten metal is poured into the inlet end of an open-ended mould while liquid coolant is applied to the inner periphery of the mould to solidify the metal as ingot. Also, the same or different coolant is normally applied to the exposed surface of the ingot as it emerges from the outlet end of the mould, to continue the cooling effect on the solidifying metal.

The form of such moulds has been generally standardized because of manufacturing practices and the particular necessities of an internal surface defining in a horizontal plane the periphery of the ingot to be cast. The vertical height of the internal surface of the mould is somewhat limited to alleviate sticking of the cast ingot after solidification of its surface, and to allow immediate impingement of coolant to prevent undesirable physical changes in the ingot. Typical direct chill casting moulds of the above type are described in U.S. Pat. Nos. 3,688,834; 3,739,837 and 4,421,155.

In using such moulds, various problems have been experienced. In particular, the mould configuration tends to skew with use and its individual elements tend to warp, caused primarily by the thermal activities of the casting process. An attempt was made to solve the above problem in the mould described in U.S. Pat. No. 3,688,834 by changing the mould configuration to provide a thicker inner or moulding surface. It was believed that this thicker surface cooperating with the other mould parts would prevent warpage because of its beam effect.

It is an object of the present invention to provide an improved direct chill casting system in which the above problems are avoided.

SUMMARY OF THE INVENTION

The mould configuration of the present invention represents a significant departure from the traditional direct chill casting mould. Thus, the mould of this invention is in the form of a heavy plate in which the internal mould surface has a vertical height which is substantially less than the lateral width of the mould plate adjacent the internal mould surface. A typical previously known direct chill casting mould had a vertical height of no less than about 75 to 125 mm. The mould plate of this invention provides an internal mould surface having a vertical height of typically less than 50 mm. On the other hand, the horizontal width of the mould plate of this invention adjacent the internal mould surface is typically at least twice the vertical height of the mould face and is preferably at least three to four times the vertical height.

An important further feature of the present invention is the arrangement of the coolant channel within the mould. This is in the form of a channel or channels within the mould plate connected via inlets to a coolant manifold or manifolds positioned beneath the mould plate. When the mould is rectangular or square, a separate coolant channel means is provided adjacent each mould surface. Each coolant channel includes a horizontal portion extending toward the moulding surface edge of the moulding plate and connecting to either a plurality of relatively small, spaced coolant dispersal passages or a dispersal slot communicating from the coolant channel downwardly and outwardly through an outlet or outlets in the bottom face of the mould plate adjacent the moulding surface.

Thus, the present invention in its broadest aspect relates to an apparatus for continuously casting molten metal comprising: (a) an axially upright, open-ended direct chill casting mould comprising a mould plate having an inner axially extending wall or walls defining a mould cavity, an upper annular surface and a lower annular surface, with the horizontal dimensions of the cross-section of the annular portion of the mould plate being greater than the vertical height, (b) a coolant channel or channels formed within the mould generally parallel to and laterally spaced from the cavity-defining wall or walls, (c) coolant dispersal passage or passages extending downwardly and outwardly between the coolant channel or channels and the lower surface of the mould plate adjacent the mould cavity, and (d) a coolant manifold or manifolds mounted on the lower surface of the mould beneath the coolant channel or channels and adapted to supply coolant fluid to the coolant channel or channels.

The casting apparatus of this invention can be adapted to produce rectangular, square or round ingots as required to suit further fabrication such as rolling, extrusion, forging, etc. Thus the annular surface may define a rectangular, square or round mould cavity. When the mould is rectangular or square, it is preferable to provide a separate coolant channel parallel to and laterally spaced from each cavity-defining wall. It has been found to be unnecessary to extend the coolant channels around the corners of the mould.

The moulding plate of this invention has the important advantage of having a very high heat stability. The cross-section of the annular portion of the mould plate preferably has a horizontal dimension which is three to four times the vertical height, so that the horizontal dimension is typically greater than 100 mm preferably in the order of 100–150 mm. This mass of material forming the mould horizontally in the direction of heat flow greatly increases the resistance against deformations in that direction. Stiffness in the casting (vertical) direction may be enhanced by constructing each coolant manifold as a box structure having heavy side walls mounted to the lower or upper face of the mould. Further vertical stiffness may be provided by frame plates mounted on the upper surface of the mould, which are also useful to support an insulating head for holding molten metal.

The coolant channel within the mould provides a water guiding system which cools the upper face of the mould plate adjacent the mould cavity as well as the cavity wall. For instance, the coolant channel preferably has an upper face extending generally parallel to the mould upper surface, with the channel upper face being vertically spaced from the mould upper surface a distance of less than ½ of the total thickness of the mould. This greatly reduces the amount of heat transferred laterally through the mould plate such that the neutral axis of the mould remains at a relatively low temperature. The result is a greatly enhanced mould stability.

The mould design of this invention also makes possible the use of an internal mould surface having a small vertical height, which is in fact only the thickness of the mould plate. This is a highly desirable feature which is not possible with traditional mould designs.

BRIEF DESCRIPTION OF THE DRAWINGS

The invention will be more fully understood from the following description of an embodiment thereof, given by way of example only, with reference to the accompanying drawings, in which.

Figure 1:
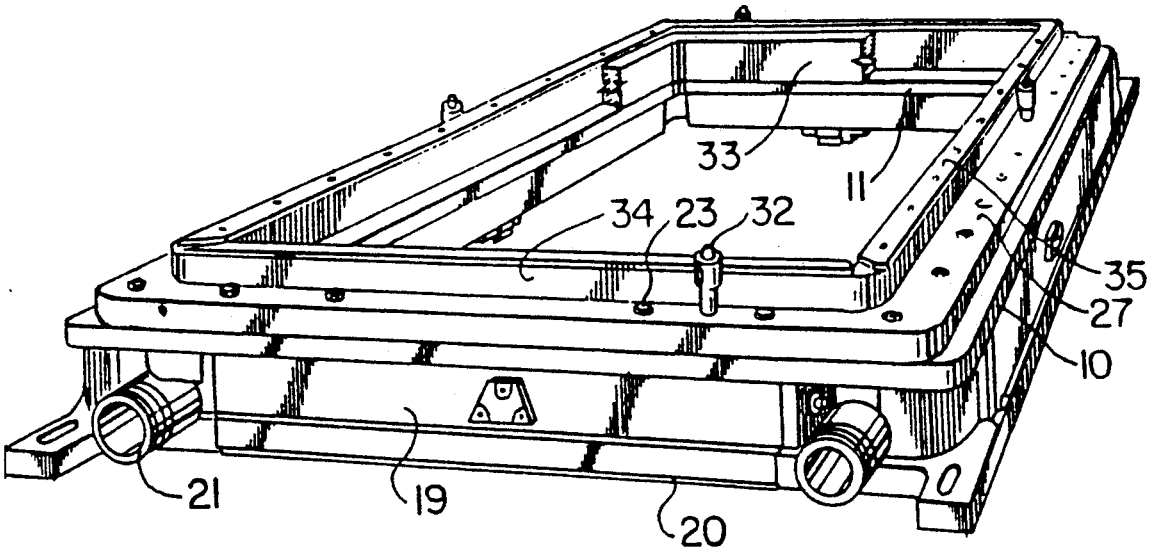
FIG. 1 is a perspective view of a mould assembly according to the invention.

The mould assembly of this invention has an open-ended rectangular, annular body configuration. The mould plate 10 has a short vertical mould face 11, a top face 12 and a bottom face 13. This plate is conveniently manufactured from aluminum and includes a coolant channels or slots 15 with a plurality of spaced dispersal passages 16 communicating between each coolant channel 15 and the bottom of the mould plate 10. The channel or channels 15 are preferably quite small bores with outer end plugs 44 to provide a high rate of coolant flow.

The coolant channels 15 are flow connected by way of holes 17 to a coolant manifold 18 mounted on the bottom face 13 of mould plate 10. The coolant manifold 18 is manufactured with heavy side walls 19 and a bottom wall 20. The heavy side walls 19 of each coolant manifold serve a significant structural purpose in that they provide rigidity to the moulding plate 10. The coolant manifold 18 is mounted to the bottom of the mould plate 10 by means of studs or bolts 23 which also extend through frame members 27. The faces between the manifold and mould plate are sealed by O-rings.

With this system, water flows under pressure into manifold reservoir 40 through inlet 21 and from here flows through screen 41 and upwardly through hole 42 in a coolant regulating plate 14. This regulating plate serves to direct the flow of coolant upwardly through holes 17 in a uniform manner. The coolant then flows along the channel or channels 15 extending parallel to the top face 12 of the mould plate 10. Preferably a series of laterally spaced bores are used for the channels, e.g. bores having a diameter of about 4 mm and spaced from each other by a distance of about 6 mm. The tops of the channels 15 are preferably only a short distance below the top face of the mould, e.g. no more than about 10 mm to assure a good cooling effect on the outer face of the mould.

Figure 3:
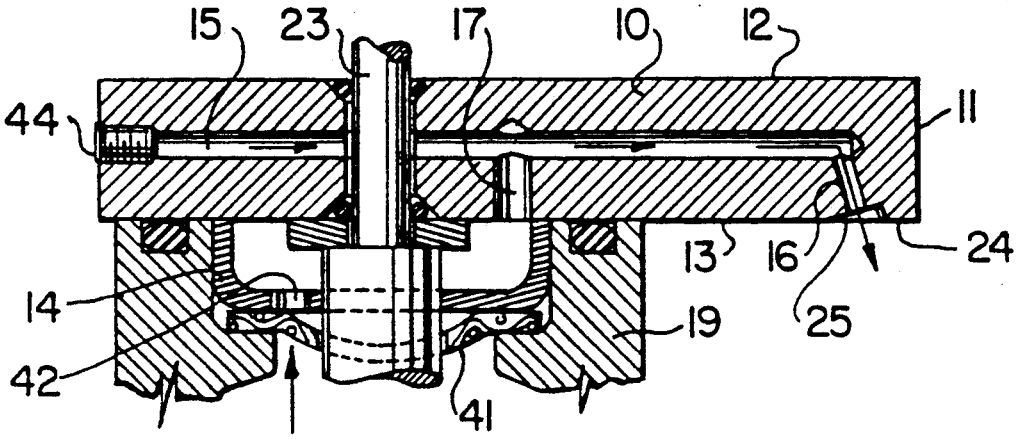
FIG. 3 is a sectional view of the mould plate of the invention.
Figure 4:
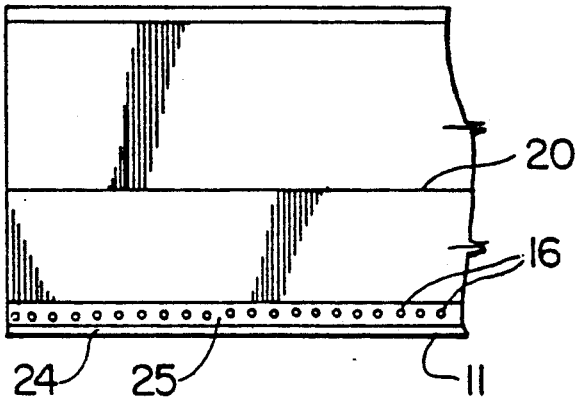
FIG. 4 is a bottom view of a mould plate of the invention.

The water flowing through the channels or slots 15 flow out through dispersal passages 16. These outlet passages 16 are, as shown in FIG. 3, on a chamfered bottom face portion 25 spaced from mould face 11 by a narrow projecting lip 24.

The inlet portion of the mould assembly includes an insulated head 33 which generally conforms to the shape of the mould with which it is associated. This insulated head as is formed of a heat resistant and insulating material, such a refractory material, which will not deteriorate when in contact with the molten metal to be cast. This head 33 is located at a position contiguous with or adjacent to and extending around the periphery of the top portion of the mould wall face 11. The use of such insulated head provides for relatively constant withdrawal of heat from the molten metal during the casting operation when using a short mould wall. The insulating material 33 is held in place by frame members 27 and top plates 35. These may be made from aluminum and are preferably bolted to the mould plate 10. Each frame member 27 includes recesses 28 which hold O-rings to provide a seal against the top face of the mould. An oil plate 31 is sandwiched between frame member 27 and insulating member 33 on the one side and the mould plate 10 on the other side. This oil plate 31 flow connects at the inner edge thereof by way of oil channels 29 to an oil reservoir 30 formed within the frame member 27. Oil is preferably supplied to the reservoir via connector 32. This oil system is described in greater detail in Mueller & Leblanc, Canadian patent application Serial No. 585,388, filed Dec. 8, 1988.

Figure 2:
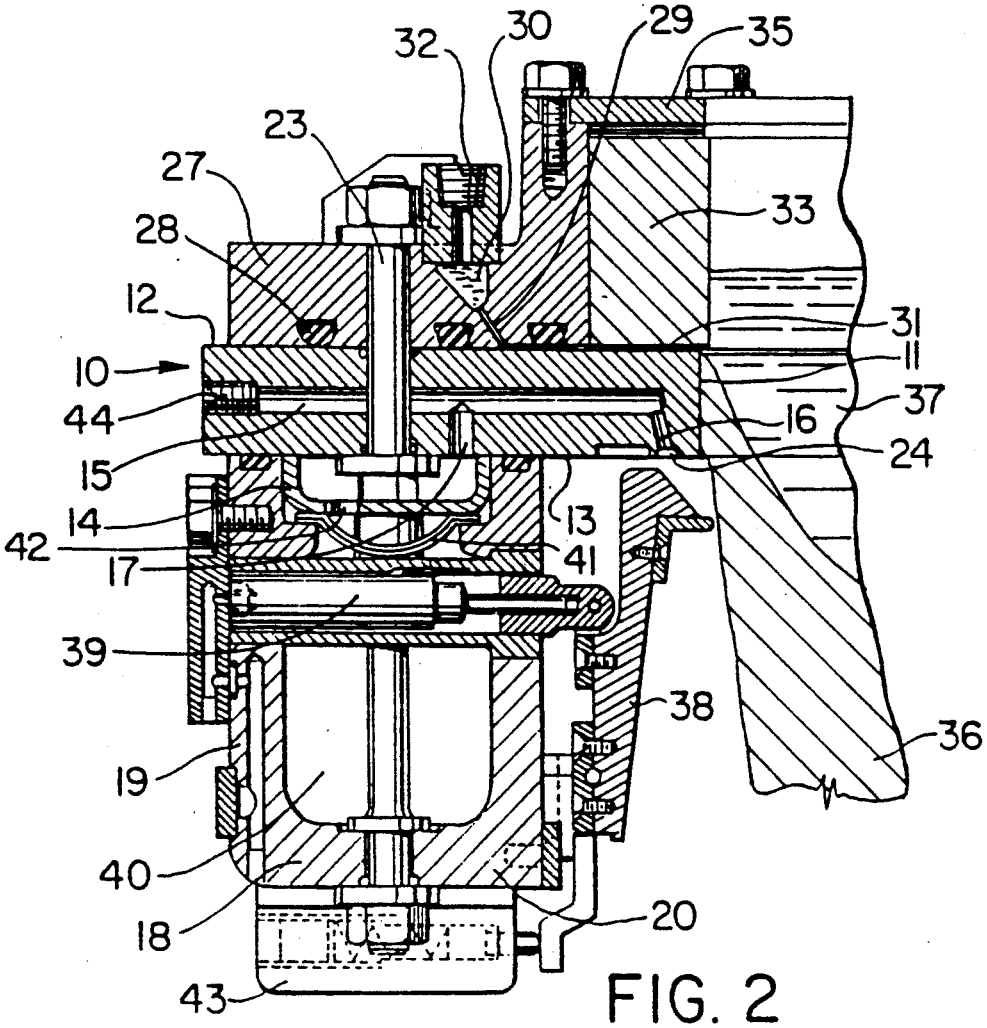
FIG. 2 is a sectional view of a mould assembly according to the invention.

In operation, molten metal 37 is fed into the inlet consisting of the insulating head 33. Initial cooling takes place by contact with the mould face 11 and an outer skin is formed. This outer skin 36 is sprayed with cooling water below the mould skirt to provide further solidification and this causes a shrinkage of the ingot as shown in FIG. 2. The direction of the water spray may conveniently be adjusted by means of a deflector baffle 38 which moves by actuator mechanism 39. This baffle is pivotally mounted and is spring biased by spring mechanism 43 in a direction to move away from ingot 36. The baffle arrangement is described in greater detail in Mueller & Leblanc, U.S. patent application Ser. No. 07/446,100 filed Dec. 5, 1989.

It will be obvious that various modifications and alterations may be made in this invention without departing from the spirit and scope thereof and it is not to be taken as limited except for the appended claims herein.

We claim:

1. Apparatus for continuously casting molten metal comprising:

(a) an axially upright, open-ended direct chill casting mould plate having an inner axially extending wall or walls defining a mould cavity, an upper annular surface and a lower annular surface, with the horizontal dimension of the cross-section of the annular portion of the mould plate being at least twice the vertical height, (b) at least one coolant channel formed within the mould generally parallel to the mould plate upper annular surface and laterally spaced from said cavity-defining walls, (c) coolant dispersal passage means extending downwardly and outwardly between said coolant channel and the lower surface of the mould adjacent the mould cavity, and (d) a coolant manifold mounted on the lower surface of the mould beneath each said coolant channel and adapted to supply coolant fluid to said coolant channel.

2. An apparatus according to claim 1 wherein the mould cavity is shaped to form a generally rectangular or square casting.

3. An apparatus according to claim 1 wherein the coolant channel has a upper face extending generally parallel to the mould upper surface, said channel upper face being vertically spaced from said mould upper surface a distance less than one half of the total thickness of the mould.

4. An apparatus according to claim 1 wherein the mould plate cavity-defining wall has a height of no more than 50 mm.

5. An apparatus according to claim 4 wherein the horizontal dimension of the cross-section is greater than 100 mm.

6. An apparatus according to claim 4 wherein the distance between the upper face of the coolant channel and the mould upper surface is no more than 10 mm.

7. An apparatus according to claim 1 wherein the coolant manifold is a box structure having heavy side wall and serving as a stiffener for the mould.

8. An apparatus according to claim 7, which includes plate-like frame members mounted on the mould upper surface, said frame member being generally parallel to and laterally spaced from said cavity and being adapted to provide further rigidity to the mould and support an insulating head for holding molten metal above the mould.

9. An apparatus according to claim 8, wherein the mould plate, coolant manifold and plate-like frame members are bolted together to form a rigid assembly.

* * * * *